US006803751B2

(12) United States Patent
Messager

(10) Patent No.: US 6,803,751 B2
(45) Date of Patent: Oct. 12, 2004

(54) POWER SUPPLY CONTROLLER FOR ELECTRONIC CIRCUITS, COMPONENTS AND CORRESPONDING DEVICES

(75) Inventor: Philippe Messager, Nantes (FR)

(73) Assignee: Atmel Nantes S.A., Nantes (FR)

( * ) Notice: Subject to any disclaimer, the term of this patent is extended or adjusted under 35 U.S.C. 154(b) by 0 days.

(21) Appl. No.: 10/279,735

(22) Filed: Oct. 24, 2002

(65) Prior Publication Data

US 2003/0076077 A1 Apr. 24, 2003

(30) Foreign Application Priority Data

Oct. 24, 2001 (FR) ..... 01 13775

(51) Int. Cl.[7] ..... G05F 1/40
(52) U.S. Cl. ..... 323/273
(58) Field of Search ..... 323/268, 270, 323/271, 273, 274, 275, 279–282, 284, 285, 313, 314

(56) References Cited

U.S. PATENT DOCUMENTS 5,617,306 A * 4/1997 Lai et al. ..... 363/17
5,686,820 A 11/1997 Riggio, Jr. ..... 323/273
5,861,737 A 1/1999 Goerke et al. ..... 323/282
6,057,675 A * 5/2000 Tateishi ..... 323/283
6,130,528 A * 10/2000 Aoyama ..... 323/282
6,137,275 A 10/2000 Ravon ..... 323/274
6,181,118 B1 1/2001 Meehan et al. ..... 323/274
6,519,167 B1 * 2/2003 Nguyen ..... 363/41

FOREIGN PATENT DOCUMENTS

GB 2 182 788 A 5/1987

OTHER PUBLICATIONS

"Soft–start regulator starts at OV", by Gerald L. Kmetz, for *EDM Design Ideas,* XP 000622006, vol. 41, No. 12, pp. 104–106 Jun. 6, 1996.

* cited by examiner

*Primary Examiner*—Matthew V. Nguyen
(74) *Attorney, Agent, or Firm*—Westman, Champlin & Kelly

(57) ABSTRACT

A power supply controller for electronic circuits, supplying a power supply voltage (VDC) and preventing operation of the said circuit by using a RESET signal when the said power supply voltage is less than a first predetermined threshold. The controller includes a first comparator (C2) comparing a voltage proportional to the power supply voltage with a reference voltage and activating the reset signal when the voltage proportional to the power supply voltage is less than the reference voltage. A bandgap module supplies a principal reference voltage (VBGAP). Preliminary reference devices immediately supply a preliminary reference voltage (V09), less than the principal reference voltage. Control circuits receive the preliminary reference voltage (V09) and the principal reference voltage (VBGAP) and automatically activate the RESET signal for as long as the principal reference voltage (VBGAP) has not reached a second predetermined threshold.

20 Claims, 6 Drawing Sheets

POWER SUPPLY CONTROLLER FOR ELECTRONIC CIRCUITS, COMPONENTS AND CORRESPONDING DEVICES

FIELD OF THE INVENTION

The field of the invention is that of electronic circuits. More precisely, the invention concerns the electrical power supply for such circuits and in particular the voltage of the supplied power.

BACKGROUND OF THE INVENTION

Micro-electronic circuits are designed to operate at a nominal power supply voltage (for example VDC=5 V). They can certainly operate over a predetermined range of voltages around this nominal value, however their correct operation cannot be guaranteed outside this range. For example, a memory supplied with a too low voltage (for example VDC MIN=2.55 V) may exhibit random behaviour, leading to undesired read/write operations.

It is therefore necessary to monitor the supply voltage to the circuit and only permit it to operate when the supply voltage is within the desired range (for example VDC>2.55 V). In this way the circuit will only operate when it is actually capable of operating without causing an error. Below the nominal supply voltage the circuit is forced into RESET mode.

This is the role of the power supply controller.

As is well known, in order to know precisely the supply voltage VDC supplied to a circuit, a part of this voltage VDC is generally compared at the output of a voltage reference module in accordance with the principle illustrated in FIG. 1.

The bandgap module 11 is based on pnp transistors which output a precise reference voltage Vref (for example Vref=1.25 V). A voltage divider 12, formed from two resistors R1 and R2 (for example each of 100 kΩ) outputs a fraction of VDC (in the described example: VDC/2). These two voltages are sent to a comparator 13 which triggers a RESET command whenever VDC/2<Vref. A RESET is therefore obtained whenever VDC/2<2.5 V.

A problem with this technique is that while it is effective for slow voltage rises, it does not work for rapid voltage rises. In fact, in this case, the output of the bandgap module can remain at 0 V even though the supply voltage VDC has already reached 2 V, for example. The comparator 13 triggers the RESET command even though the supply voltage has still not reached the desired nominal value.

In order to alleviate this problem, we considered adding to the controller a RC circuit 21 for the supply voltage VDC as shown in FIG. 2. This RC circuit forces a RESET command for rapid rises while waiting for the device in FIG. 1 to trigger.

However, this technique is not 100% reliable. Depending on the slope of the voltage rise, the supply voltage VDC and the temperature and/or the technology used, the RC circuit 21 may trigger the RESET command while the part of the detector shown in FIG. 1 is no longer operating.

In addition, this technique is not suitable for circuits using thin film technology (0.35 μm for example) which does not support a supply voltage greater than a predetermined threshold (for example 4 V).

Therefore, if we consider a circuit that must be able to operate with a battery voltage (VBAT) of between 2.5 and 5.5 V, while the technology cannot support more than 4 V, an internal regulator is connected (from a bandgap module), which will supply the remainder of the circuit with 3 V. However, all the circuits connected to VBAT must then be built with transistors that can withstand 5.5 V. It must therefore use a thicker oxide layer (for example 0.6 μm) which is less efficient. This applies in particular to the bandgap module and the 3 V regulator.

This implies that the bandgap module only operates from a minimum voltage of 2.4 V, for example, while with 3 V transistors, it would operate from 1.6 V. With such a device, in the case of a slow rise in voltage to 2.3 V, the RC circuit 21 triggers the RESET command while the bandgap module is still at 0 V, since it receives a lower voltage (2.3 V) than its minimum operating voltage (2.4 V).

Again the comparator 12 triggers the RESET command (since it sees VDC/2=1.15 V>0 V), while the supply voltage VDC has not risen to 2.55 V.

In addition, using this technique, it is not possible to control voltages of less than 2.4 V since the bandgap module no longer operates.

The invention has the particular objective of alleviating the problems of current technology.

More precisely, one objective is to provide a power supply controller for electronic circuits that operates efficiently and reliably to prevent the operation of a circuit until the supply voltage has reached a threshold value, under all conditions, and in particular whether the voltage rises are slow or rapid.

Another objective of the invention is to provide such a power supply controller that is simple, inexpensive and easy to build and implement. In particular, it is an objective of the invention to provide such a controller, all of whose constituent parts can be built using the same technology, in particular thin film technology.

The invention also has the objective of providing such a power supply controller that can work at low voltages compared with earlier technology (and for example less than 2.4 V).

SUMMARY OF THE INVENTION

These objectives, as well as others that will be revealed later, are achieved by using a power supply controller for an electronic circuit providing a supply voltage (VDC) and preventing the operation of the circuit by using a RESET signal when the supply voltage is below a first predetermined threshold, the controller comprising a first comparator (C2) comparing a voltage proportional to supply voltage with a reference voltage and activating the RESET signal when the voltage proportional to the supply voltage is lower than the reference voltage and a bandgap module that provides the principal reference voltage (VBGAP).

According to the invention, the controller includes preliminary reference devices, immediately supplying a preliminary reference voltage (V09), that is lower than the principal reference voltage, but fairly accurate, and control circuits receiving the preliminary reference voltage (V09) and the principal reference voltage (VBGAP) and automatically activating the RESET signal for as long as the principal reference voltage (VBGAP) has not reached a second predetermined threshold.

Thus, as long as the principal reference voltage is not available and whether the voltage rise is slow or rapid, means are available to ensure that the RESET command is triggered and that therefore there will be no random operation of the circuit due to the supply voltage being too low.

It is preferable that the means of control should include means for selecting a reference voltage (VREF) for the first comparator (C2) between the preliminary reference voltage (V09) and the principal reference voltage (VBGAP), the preliminary reference voltage (V09) being selected for as long as the principal reference voltage (VBGAP) has not reached the second predetermined threshold.

The power supply controller also includes a regulation module providing a regulated supply voltage (VDC) to the circuit which takes advantage of the reference voltage (VREF).

According to an advantageous aspect of the invention, the regulated supply voltage CVDC) also supplies the bandgap module. This permits the latter to be built using thinner technology and to operate at lower voltages.

According to another advantageous characteristic of the invention, the control circuits issue a command to the regulation device, controlling the means of amplification of the regulated supply voltage (VDC) at a third predetermined threshold, until the principal reference voltage reaches the first predetermined threshold.

The gain is therefore temporarily increased while using the preliminary reference voltage to take account of the fact that it is lower and nevertheless obtain an acceptable supply voltage.

In accordance with a preferable mode of operation, the preliminary reference devices include a transistor connected as a diode.

Advantageously, the control devices include a second comparator (C1) supplied from the preliminary (V09) and principal (VBGAP) reference voltages and supplying an inverter (INV) driving a transistor (TP1) provided to force the RESET signal.

Preferably, the means of selection include two transistors, receiving respectively the preliminary (V09) and principal (VBGAP) reference voltages and driven respectively by the output of the second comparator (C1) and the output of the inverter (INV).

According to an advantageous characteristic, the regulation devices include an amplifier (AOP) supplying the regulated supply voltage (VDC) and supplied partly from the reference voltage (VREF) and partly from a voltage divider to which the regulated supply voltage (VDC) is fed back.

Preferably, the limiting devices include a transistor connected so as to short circuit part of the voltage divider.

The invention also concerns electronic components and electronic devices including, or working with, at least one power supply controller as described above.

BRIEF DESCRIPTION OF THE DRAWINGS

Other characteristics and advantages of the invention will be more clearly seen on reading the following description of a preferable method of implementation of the invention given as a simple but not exhaustive example for illustration purposes and the attached drawings, including:

FIGS. 5A and 5B: rapid voltage rise;

FIGS. 7A and 7B: voltage drop.

DETAILED DESCRIPTION OF THE PREFERRED EMBODIMENTS

Figure 1:
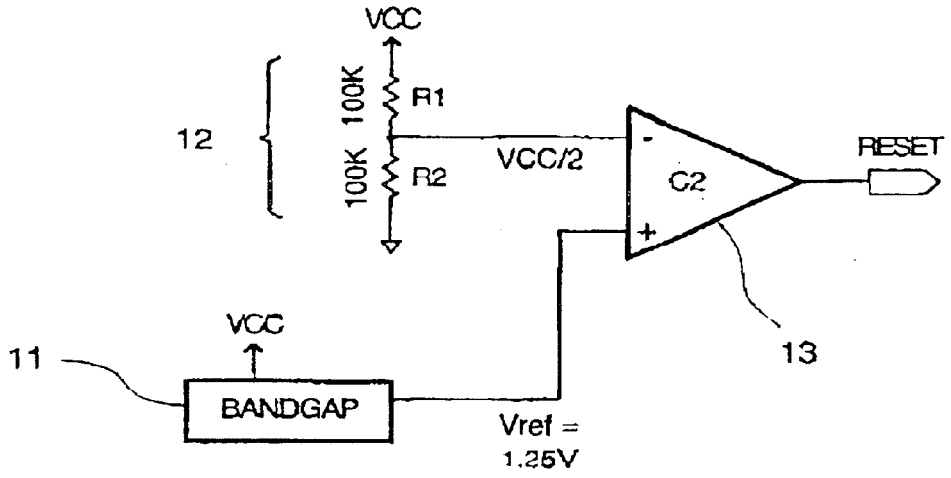
Fig. 1 Prior Art
FIGS. 1 and 2, already referred to in the introduction, showing two known techniques for monitoring the power supply with and without a RC circuit respectively.
Figure 2:
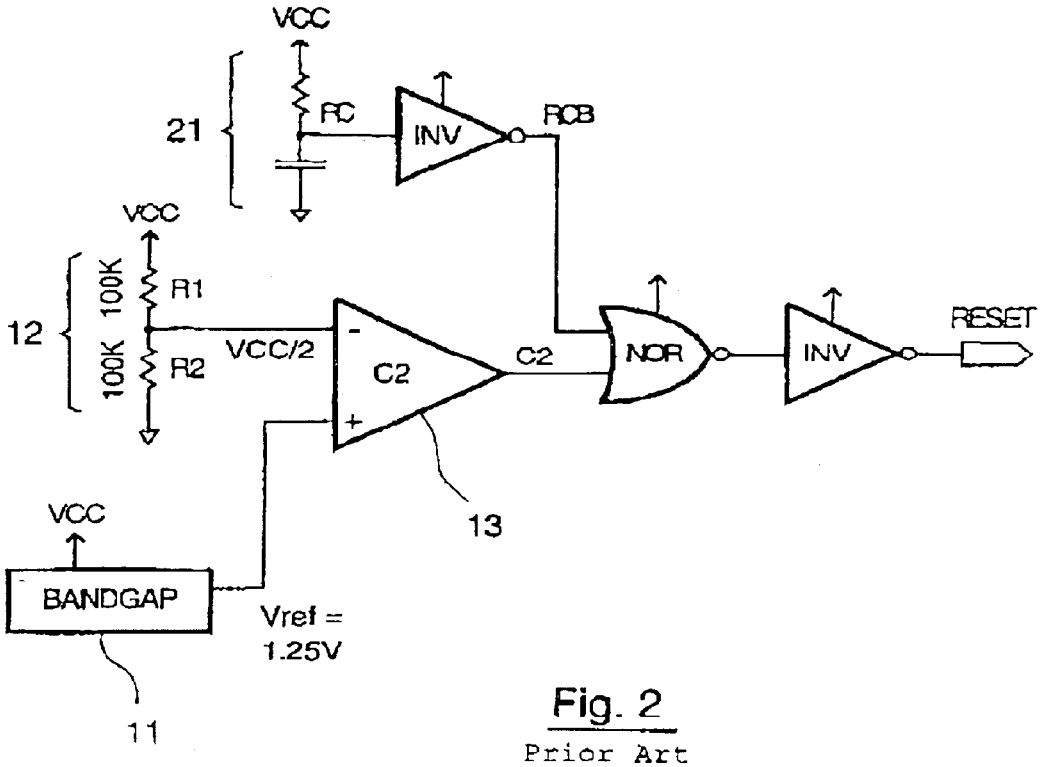
Fig. 2 Prior Art
Figure 3:
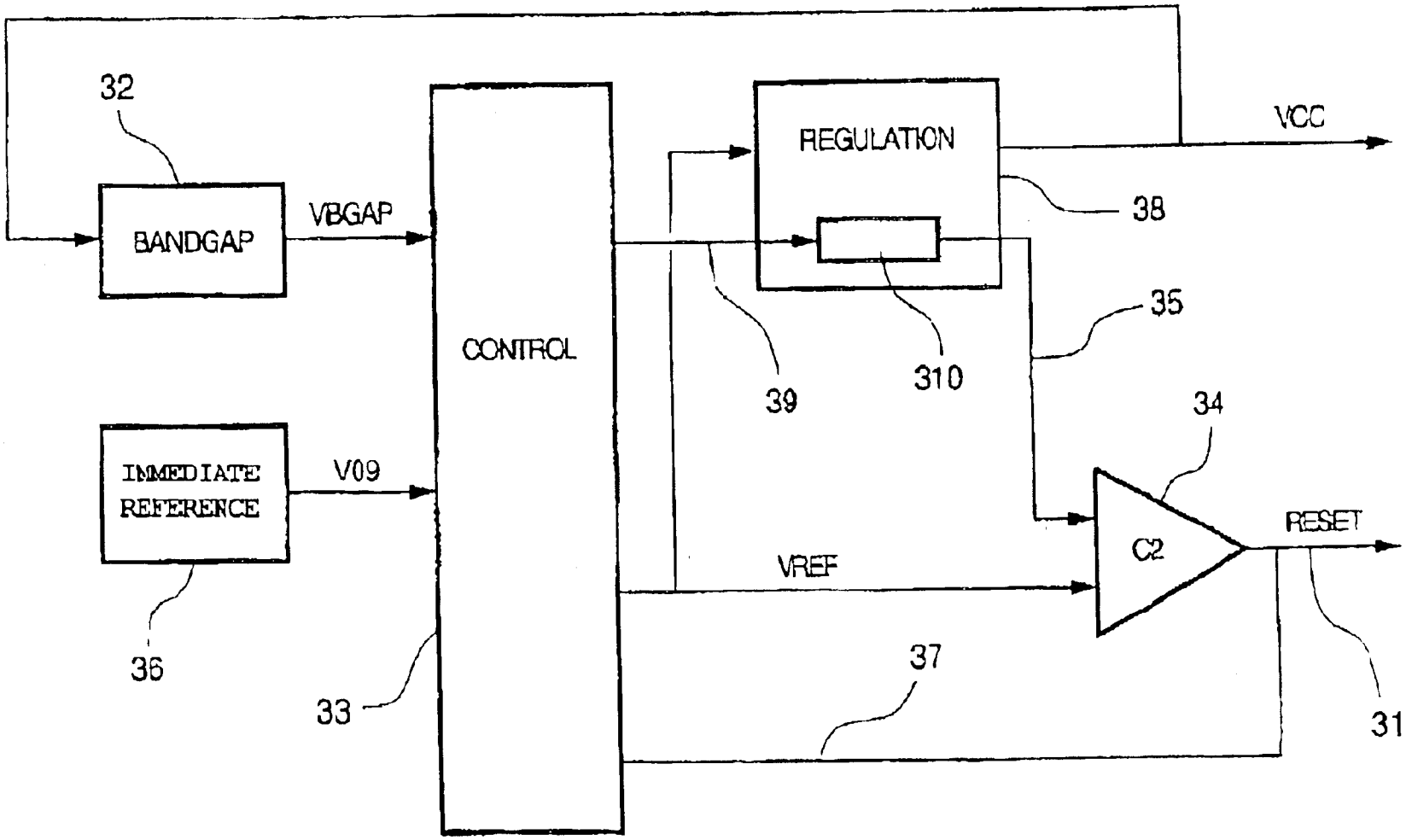
FIG. 3 is a functional diagram of a power supply controller according to the invention.

FIG. 3 shows the general principle of the invention in the form of a simplified functional diagram.

As explained in the introduction, the principal purpose of a power supply controller is to prevent the circuit supplied from starting to work before the supply voltage has reached a predetermined sufficient value. For as long as this is not the case, the controller sends a RESET command 31 to the circuit which forces it into the reset mode.

The controller according to the invention still includes a bandgap module 32, whose construction is well known, provided to supply a principal stable reference voltage VBGAP. Control circuits 33 direct this to a comparator C2 34, which also receives a voltage 35 representative of the supply voltage to the circuit. For as long as the latter is less than the reference voltage, the comparator 34 supplies a RESET command 31.

In order to alleviate the problems with the earlier technology, an immediate reference 36 is also provided that instantly provides a preliminary reference voltage (V09) which need only be fairly accurate but which is available instantaneously, before the bandgap module becomes active.

The control circuits 33 are designed to select as the reference voltage VREF, either the voltage V09 or the voltage VBGAP, depending on whether the latter is or is not sufficient, for example according to the rule:

VREF=MAX (V09, VBGAP).

Therefore, during the voltage rise stage, VBGAP is temporarily replaced with another voltage that is immediately available.

The control circuits 33 operate directly (37) on the RESET command 31 until the bandgap module starts.

The controller also includes regulation circuits 38 that deliver the power supply voltage VDC (for example 3 V) to the circuit. These circuits 38 take into account the voltage VREF to adjust the power supply.

According to a special aspect of the invention, the bandgap module 32 is supplied by the voltage VDC (and not, classically, by the battery voltage VBAT), which permits it to operate at lower voltages and with thinner transistors.

In addition, the control module 33 delivers to the regulator circuits 38 a gain adjustment command 39 which acts on the circuits 30 for amplifying the regulated voltage for as long as VBGAP has not reached its minimum operating value.

Figure 4:
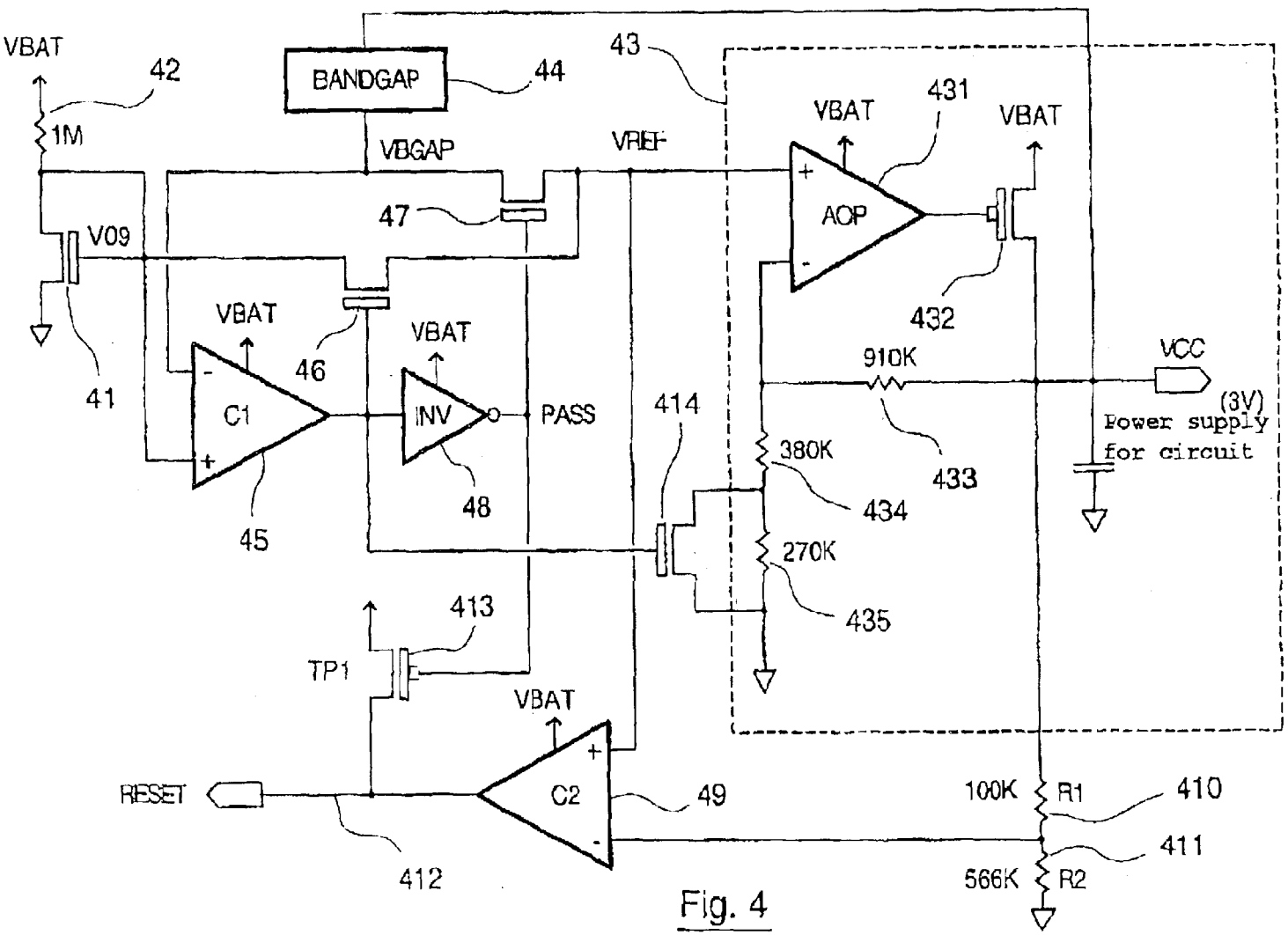
FIG. 4 shows in greater detail a method of constructing the control system in FIG. 3.

A special method of implementation of this power supply controller, illustrated in FIG. 4 is now presented.

The immediate reference V09 is obtained by using a transistor 41 as a diode and connected to the battery (VBAT, of the order of 2.5 V to 5.5 V), via a resistor 42, for example 1 MΩ. This transistor then supplies a voltage V09 lower than the bandgap voltage, of the order of 0.9 V. This voltage can vary between 0.6 V and 1 V depending on the technology, the power supply voltage and especially the temperature.

This preliminary reference V09 is present from the start, whatever the voltage rise time. It will serve as a preliminary reference to the regulation circuits 43 to supply a voltage VDC of 3 V.

The regulation circuits 43 are similar to a multiplier circuit with a factor of 2.4 (3 V/1.25 V=2.4). With the preliminary reference VREF at 0.9 V, it therefore generates 2.16 V. It includes an operational amplifier 431, whose output supplies the voltage VDC via a transistor 432. This output is fed back to the input negatively via a resistor 433 of 910 kΩ.

The output voltage VDC also supplies the bandgap module 44. It is therefore not supplied directly by the battery VBAT but, like the rest of the circuit, by the voltage VDC. It therefore only sees a maximum voltage of 3 V. Consequently, it can be built using thin oxide transistors that are more efficient.

The minimum operating voltage of this new bandgap module is therefore 1.6 V instead of 2.4 V.

A comparator C1 45 compares the output of the bandgap module (VBGAP) and the preliminary reference voltage V09. When the principal reference VBGAP exceeds the preliminary reference V09, that is when VDC is greater than 1.6 V and there has been sufficient time for the bandgap module to initialize, the reference voltage VREF is VBGAP. Before that it is V09.

To achieve this, the output of the comparator 45 acts on the two pass transistors 46 and 47 in the following way:

directly on transistor 46, which outputs V09;

via an inverter 48 to transistor 47, which outputs VBGAP.

As soon as VBGAP is used as the reference, the regulation circuits 43 regulate at 2.4 times VBGAP and stabilize at around 3 V.

According to the invention, VREF is therefore initially equal to V09, then to VBGAP, as soon as this exceeds V09, or:

VREF=MAX (V09, VBGAP).

VREF feeds a comparator C2 49 which compares VREF to part of VDC supplied from a voltage divider comprising two resistors 410 and 411 of 100 kΩ and 96 kΩ respectively.

The output of comparator C2 49 acts as the RESET command 412.

Therefore the comparator 49 only issues the RESET command 412 when VDC/2 is greater than VREF, or VDC>2.55 V.

An additional safety device blocks the RESET command 412 via a transistor 413 controlled by the inverse (PASS) of the output of the comparator 45. Therefore, for as long as the comparator 45 has not switched to the voltage VBGAP, the RESET is forced.

When VREF=VBGAP, comparator 49 is triggered, to issue or not the RESET 412 depending on the level of the supply voltage VDC and therefore very precisely.

According to a special aspect of the invention, means have been provided for altering the multiplication factor of the regulating circuits 43. To do this, for as long as VREF=V09, the resistor 435 is short circuited when the output of the comparator 45 is active, that is when VREF=V09.

Therefore it is possible to generate a voltage close to 3 V as soon as possible, so as to be certain that the bandgap module starts even if V09 is only 0.6 V (if not, that is in the absence of transistor 414, 0.6 V×2.4=1.44 V: the bandgap module might not start with such a supply voltage).

The general operation of the controller is therefore as follows: as the supply voltage VBAT rises, the voltage V09 is present from the start. The regulator 43 is used as a reference and generates about 3 V, the gain being controlled by the transistor 414. This voltage permits the bandgap module 44 to start. During this time, the RESET 412 is forced to VDC.

When the bandgap module operates (i.e. VBGAP>V09), the regulator 43 then uses VBGAP as a reference and generates 3 V. The comparator C1 45 triggers the RESET and it is the comparator C2 49 that controls the latter and will only trigger it when VDC>2.55 V.

Figure 5A:
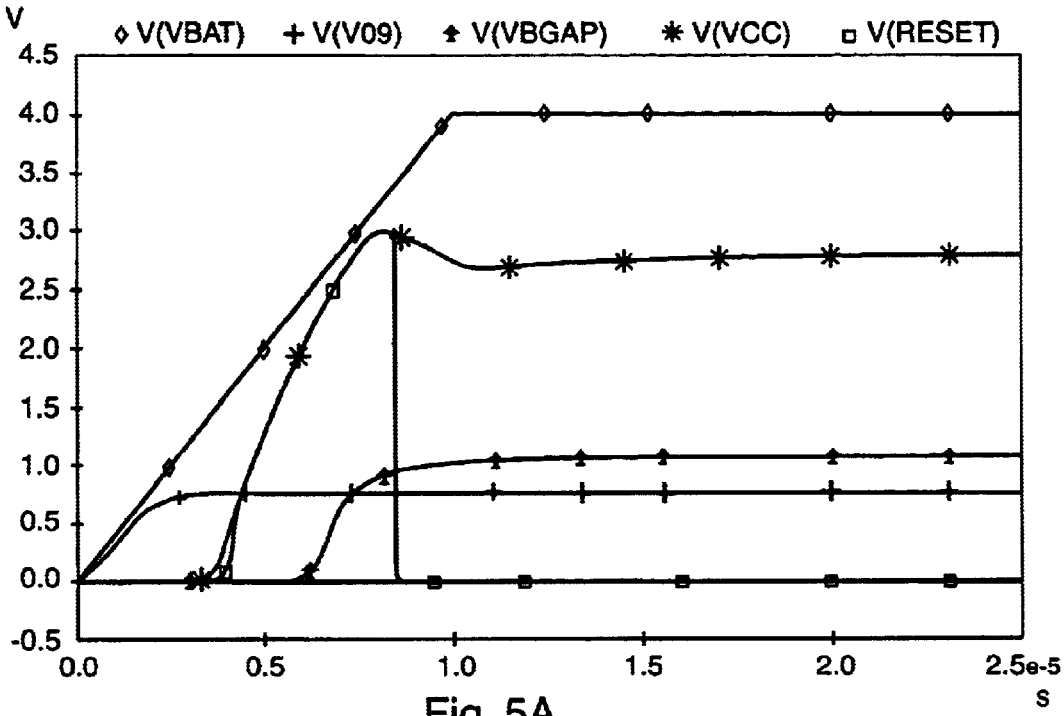
FIGS. 5A and 7B show various simulations of operation of the controller in FIG. 4, respectively.
Figure 5B:
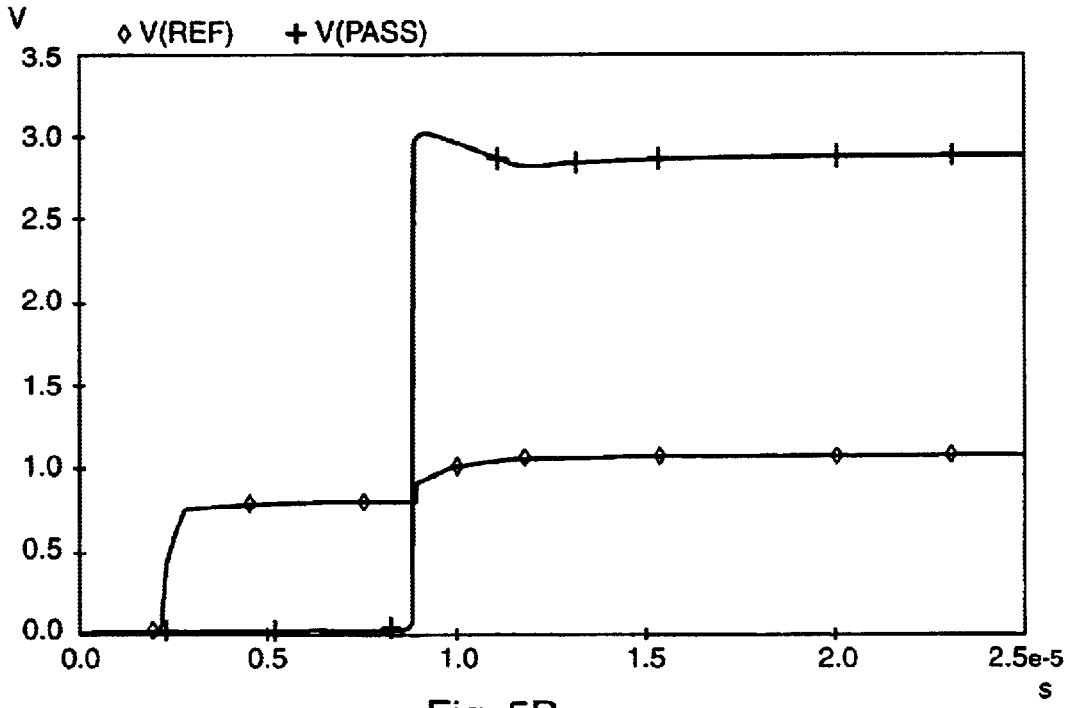

FIGS. 5A and 5B show a simulation of the various voltages VBAT, V09, VBGAP, VDC, RESET (FIG. 5A) and REF, PASS (FIG. 5B), in the case of a rapid voltage rise of 10 μs. (operating even at 100 ns), with VBGAP=1.16 V instead of 1.25 V, and therefore a regulation factor of 2.6 instead of 2.4.

It can be seen that V09 is present almost immediately. The regulator tries to generate VDC at about 3 V as soon as VBAT is sufficient for it to operate. The bandgap module is then powered by VDC and takes a little time before starting.

When VBGAP>V09, PASS permits the regulator to use VBGAP as a reference instead of V09 and VDC will then be regulated accurately from the bandgap module.

For as long as VBGAP<V09, the RESET is blocked to VDC. Therefore the whole circuit supplied from VDC remains subject to RESET. In the case of a rapid voltage rise, VDC>2.55 V when the bandgap exceeds V09 and the RESET is triggered as soon as PASS switches.

Then, VBGAP=1.16 for as long as VDC>1.6 V.

The supply voltages can then be checked up to 1.6 v by altering the ratio R1/R2 of the resistors 410 and 411.

Figure 6A:
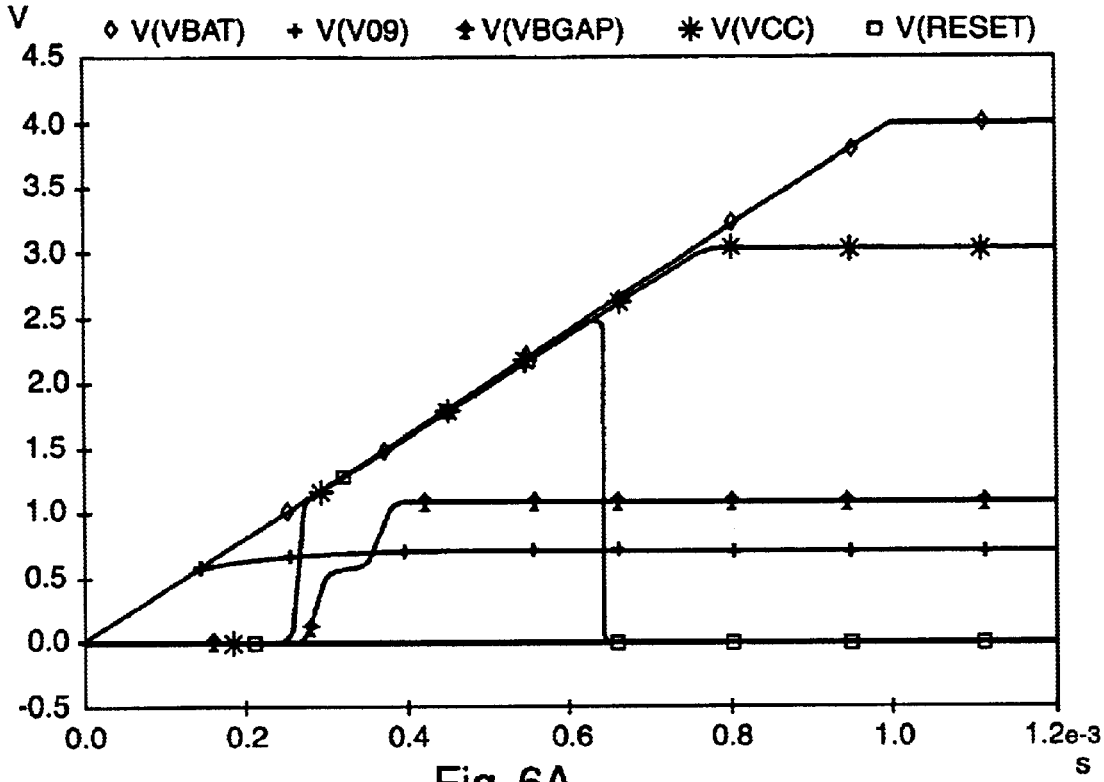
FIGS. 6A and 6B: slow voltage rise.
Figure 6B:
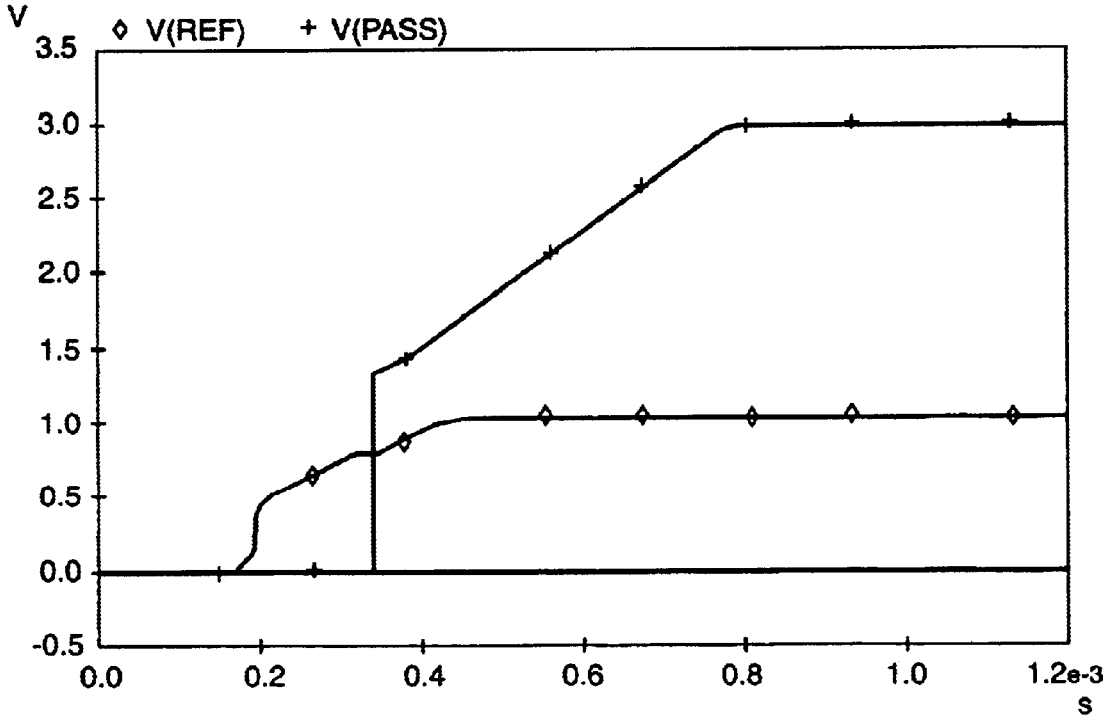
Figure 7A:
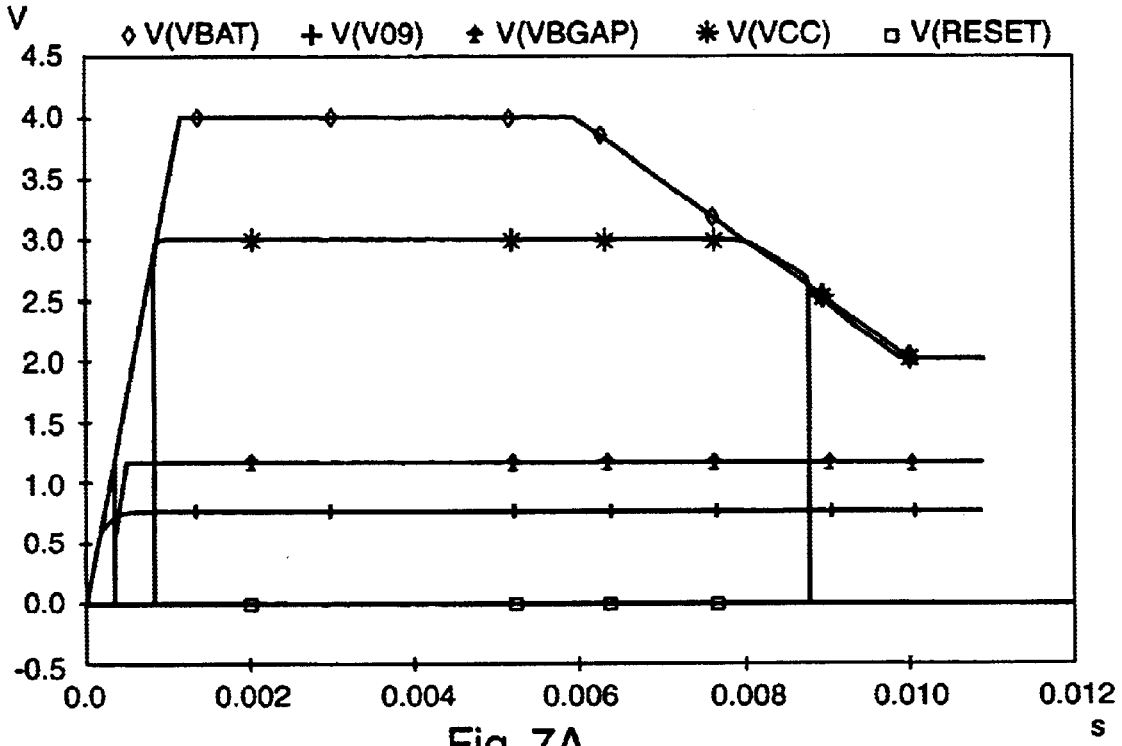
Figure 7B:
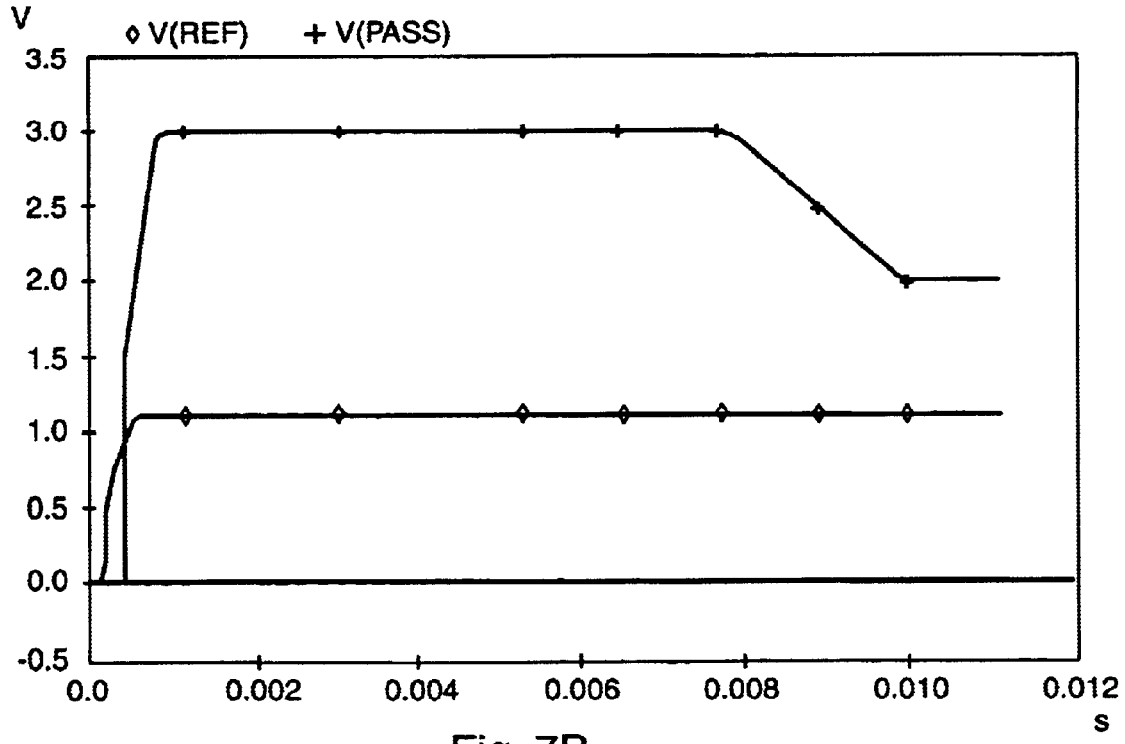

FIGS. 6A and 6B show a simulation of a slow rise in the supply voltage, with duration of 1 ms. V09 is again present from the start. The regulator tries to generate about 3 V but VBAT is still insufficient for that. Therefore VDC=VBAT for as long as VBAT<3 V. As soon as VDC is sufficient (about 1.5 V), the bandgap module 44 operates. When VBGAP>V09, the comparator C1 switches, as well as PASS, and the new reference for the regulator becomes VBGAP.

The RESET is therefore no longer controlled by the comparator C1. However, the comparator C2 compares VDC/2 and VREF (=VBGAP) and keeps the circuit under RESET for as long as VDC remains less than 2.55 V.

Then, when VBAT increases to above 3 V, the regulator 43 fulfils its role and supplies VDC=3 V precisely.

In the same way, it is possible to control voltage drops to the minimum VDC at which the bandgap module can operate, that is 1.6 V, as shown in FIGS. 6A and 6B, which shows a voltage drop with detection at 2.55 V.

Although the present invention has been described with reference to preferred embodiments, workers skilled in the art will recognize that changes may be made in form and detail without departing from the spirit and scope of the invention.

What is claimed is:

1. A power supply controller for an electronic circuit, supplying a power supply voltage and preventing operation of the circuit by using a RESET signal when the supply voltage is below a first predetermined threshold, the controller comprises a first comparator comparing a voltage proportional to the supply voltage with a reference voltage and activating the reset signal when the voltage proportional to the supply voltage is lower than the reference voltage and a bandgap module supplying a principal reference voltage, characterized in that it includes preliminary reference circuits, providing an immediate preliminary reference voltage, less than the principal reference voltage, and control circuits receiving the preliminary reference voltage and the principal reference voltage and systematically activating the RESET signal for as long as the principal reference voltage has not reached a second predetermined threshold.

2. A power supply controller in accordance with claim 1, characterized in that the control circuits include means for selecting a reference voltage for the first comparator between the preliminary reference voltage and the principal reference voltage, the preliminary reference voltage being selected for as long as the principal reference voltage has not reached the second predetermined threshold.

3. A power supply controller in accordance with claim 2, characterized in that the control circuits include a second comparator supplied by the preliminary and principal reference voltages and supplying an inverter driving a transistor provided to force the RESET signal.

4. A power supply controller in accordance with claim 3, characterized in that the means of selection include two transistors, receiving respectively the preliminary and principal reference voltages and driven by the output of the second comparator and the output of the inverter respectively.

5. A power supply controller in accordance with claim 2, characterized in that it includes a regulation module, supplying a regulated supply voltage to the circuit, taking into account the reference voltage.

6. A power supply controller in accordance with claim 5, characterized in that the control circuits include a second comparator supplied by the preliminary and principal reference voltages and supplying an inverter driving a transistor provided to force the RESET signal.

7. A power supply controller in accordance with claim 6, characterized in that the means of selection include two transistors, receiving respectively the preliminary and principal reference voltages and driven by the output of the second comparator and the output of the inverter respectively.

8. A power supply controller in accordance with claim 5, characterized in that the regulated supply voltage supplies the bandgap module.

9. A power supply controller in accordance with claim 8, characterized in that the control circuits issue a command to the regulation module, controlling means for altering a multiplication factor applied to the regulation module so as to generate the regulated power supply voltage at a third predetermined threshold for as long as the principal reference has not reached the first predetermined threshold.

10. A power supply controller in accordance with claim 9, characterized in that the regulation module includes an amplifier providing the reference voltage and powered partly by the reference voltage and partly by a voltage divider to which the regulated power supply voltage is fed back.

11. A power supply controller in accordance with claim 10, characterized in that the means for altering the multiplication factor include a transistor connected so as to short circuit part of the voltage divider.

12. A power supply controller in accordance with claim 5, characterized in that the control circuits issue a command to the regulation module, controlling means for altering a multiplication factor applied to the regulation module so as to generate the regulated power supply voltage at a third predetermined threshold for as long as the principal reference has not reached the first predetermined threshold.

13. A power supply controller in accordance with claim 12, characterized in that the regulation module includes an amplifier providing the reference voltage and powered partly by the reference voltage and partly by a voltage divider to which the regulated power supply voltage is fed back.

14. A power supply controller in accordance with claim 13, characterized in that the means for altering the multiplication factor include a transistor connected so as to short circuit part of the voltage divider.

15. A power supply controller in accordance with claim 5, characterized in that the regulation module includes an amplifier providing the reference voltage and powered partly by the reference voltage and partly by a voltage divider to which the regulated power supply voltage is fed back.

16. A power supply controller in accordance with claim 15, characterized in that the means for altering the multiplication factor include a transistor connected so as to short circuit part of the voltage divider.

17. A power supply controller in accordance with claim 1, characterized in that the preliminary reference circuits include a transistor connected as a diode.

18. A power supply controller in accordance with claim 1, characterized in that the control circuits include a second comparator supplied by the preliminary and principal reference voltages and supplying an inverter driving a transistor provided to force the RESET signal.

19. An electronic component characterized in that it includes at least one power supply controller in accordance with claim 1.

20. An electronic device characterized in that it includes at least one power supply controller in accordance with claim 1.

* * * * *